United States Patent [19]

Chuang

[11] 4,428,083

[45] Jan. 31, 1984

[54] AUTOMATIC LAVATORY SEAT

[76] Inventor: Po L. Chuang, No. 7, Lane 43, Min Chu Rd., Hsin Chu City, Taiwan

[21] Appl. No.: 251,577

[22] Filed: Apr. 6, 1981

[51] Int. Cl.[3] ..... A47K 13/12; A47K 13/04

[52] U.S. Cl. ..... 4/240; 4/241; 4/248

[58] Field of Search ..... 4/238, 251, 236, 240, 4/241, 237, 239, 248; 16/68, 50; 267/8 R, 114, 122; 92/36, 40, 8

[56] References Cited

U.S. PATENT DOCUMENTS

| | | | |
|---|---|---|---|
| 2,074,318 | 1/1957 | Ford | 267/114 |
| 2,563,095 | 8/1951 | Beyrodt | 4/251 |
| 2,776,525 | 3/1957 | Bachmann | 4/241 |

FOREIGN PATENT DOCUMENTS

| | | | |
|---|---|---|---|
| 26704 | of 1898 | United Kingdom | 267/114 |

*Primary Examiner*—John W. Shepperd
*Assistant Examiner*—Kenneth S. Putnam

[57] ABSTRACT

An automatic lavatory seat comprises a mounting seat secured to the lavatory pan, a lavatory seat connected with said mounting seat by means of a pivot pin, a coil spring around said pivot pin for raising said lavatory seat, a plunger secured at one of two opposite sides constituted by said lavatory seat and said mounting seat while a flexible hose is secured at the other, and a pneumetic valve at one end of said flexible hose, being characterized in that on removal of the load upon said lavatory seat, said flexible hose with said plunger fitted therein will resist the force exerted by said coil spring, thus producing a time lag in the return movement of said lavatory seat.

7 Claims, 3 Drawing Figures

AUTOMATIC LAVATORY SEAT

BACKGROUND OF THE INVENTION

The present invention relates to an automatic lavatory seat, particularly to one in which the raising of the lavatory seat is damped.

To prevent the lavatory seat from getting unclean, conventionally, the toilet is provided with a controlling device to automatically raise the lavatory seat. The lavatory seat forced to abruptly stand erect by the conventional controlling device may harm the user thereof. Further the sudden impact of the lavatory seat upon the water tank wall may cause a disagreeable sound.

The applicant of the present invention has previously filed an application concerning this art in Japan, the application number of which is 52-51794. Japanese Application No. 52-51794 retains the advantages of the controlling device discussed above but obviates the defects thereof. Japanese Application No. 52-51794 discloses a hydraulic coil piston which curbs the movement of the lavatory seat to a raised position. However, being intricate in construction, the controlling means according to Japanese Application No. 52-51794 is required to meet the precision to some degree. In addition, a good many of steps required in process will heighten the cost.

SUMMARY OF THE INVENTION

The present invention relates to an automatic lavatory seat, particularly to one in which the raising of the lavatory seat is damped.

Accordingly, one object of the present invention is to provide an automatic lavatory seat comprising a flexible hose and a plunger, both acting together to resist the force exerted by a coil spring which biases the seat toward a raised position.

Another object of the present invention is to provide an automatic lavatory seat which is relatively simple in construction.

Still another object of the present invention is to provide an automatic lavatory seat, wherein a majority of the parts may be made of gum or resin by means of a molding process, and thereby reducing the cost of the seat.

The present invention will be further described with reference to the accompanying drawings, the description being given by way of example only, not by way of limitation.

DETAILED DESCRIPTION OF THE INVENTION

Figure 1:
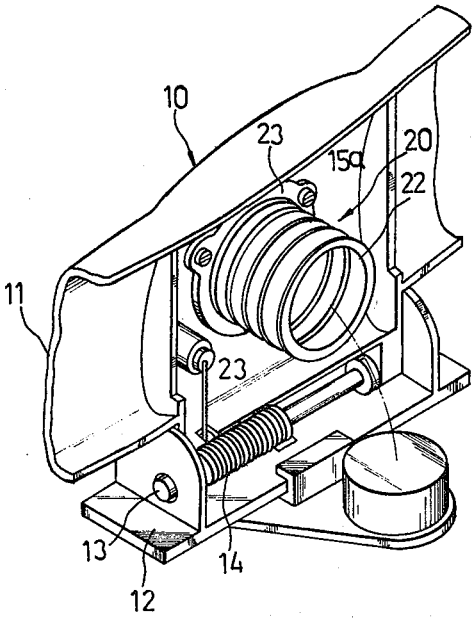
FIG. 1 is a perspective view of an embodiment of the present invention showing only a portion of the lavatory seat.
Figure 3:
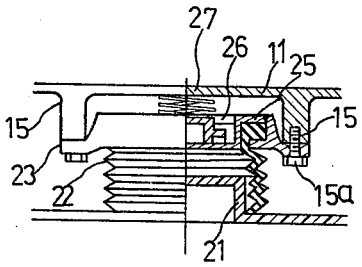
FIG. 3 is a front view, partly schematic and partly sectional, of an embodiment of the present invention.
Figure 2:
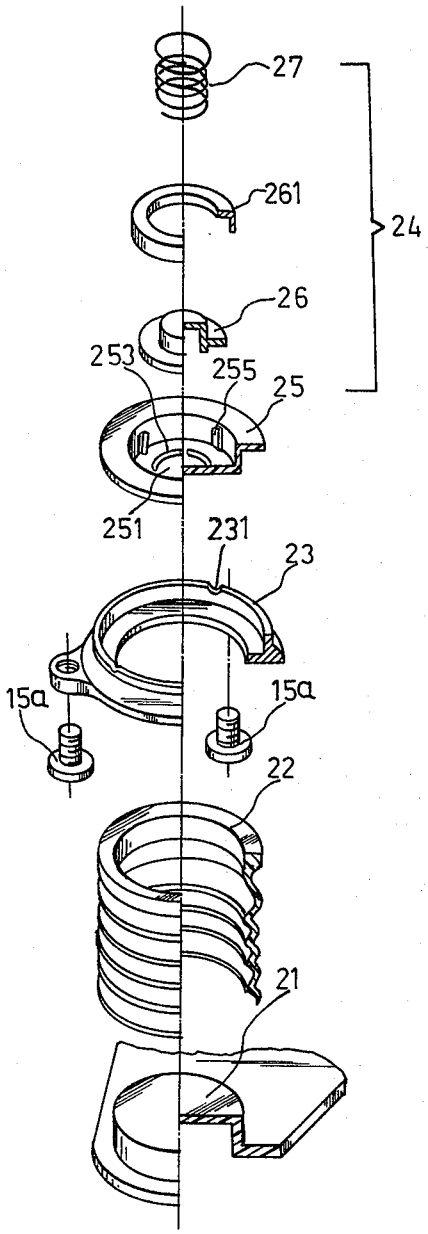
FIG. 2 is an exploded perspective view of an embodiment of the present invention with parts in longitudinal section.

Referring to FIGS. 1, 2 and 3, an automatic lavatory seat 10 comprises a mounting bracket 12 secured to the rear end of a lavatory pan (not shown), a lavatory bracket 11 connected with the mounting seat 12 by means of a pivot pin 13, a coil spring 14 around the pivot pin 13 for raising the lavatory seat 11, a plunger 21 secured to the upper side of the mounting bracket 12, and a controlling device 20 secured to the lavatory seat 11 on the side which is opposite to the plunger 21.

The plunger 21 may be made of elastic material such as gum or resin. The controlling device 20 may exchange with the plunger 21 in position. In other words, the controlling device 20 may be secured to the upper side of the mounting bracket 12 and the plunger 21 to the lavatory seat 11. The plunger 21 and the mounting seat 12 can be molded as one solid body. The plunger 21 and the lavatory seat 11 can also be formed as a single unit. A pneumatic valve 24 is held stationary against the lavatory seat 11 by a hose seat 23 (as shown in FIG. 2). The pneumatic valve 24 comprises a valve seat 25, a valve body 26, a valve ring 261 and a compression spring 27. A plurality of flanges 255 are longitudinally provided along the inner cylindrical wall of the valve seat 25.

The flanges 255 are shorter in height than the valve seat 25 whereby the valve ring 261 may fit within the valve seat 25 and stay upon the upper edges of the flanges 255. The flanges 255 and the valve seat 25 may be molded in a solid body. The bottom 251 of the valve seat 25 is provided with air passages 253. The greatest circumference of the valve body 26 is smaller than that constituted by the flanges 255 and hence, the valve body 26 under pressure may move longitudinally within the compartment formed by the valve ring 261 and the valve seat 25. The compression spring 27 is smaller in diameter than the cylindrical portion of the valve body 26. In combination, the compression spring 27 extends through the valve ring 261 to hold the valve body 26 against the valve seat 25.

As shown in FIG. 2, the hose seat 23 is provided with at least an indentation 231 along the upper circumferential edge thereof. The hose seat 23 extends sidewards with ear portions for screw heads 15*a* and screw bodies 15 to screw therethrough, whereby the hose seat 23 is secured to the lavatory seat 11. The bottom of the hose seat 23 has an inner circumference smaller than the uppermost portion of the flexible hose 22 so that the flexible hose 22 may be held stationary thereupon. In combination, the pneumatic valve 24 rests upon the valve seat 25 and valve seat 25 rests upon the upper ledge of flexible hose 22. FIG. 3 clearly illustrates this situation.

When the lavatory seat 11 is pressed against the upper edge of the lavatory pan (not shown), the plunger 21 will fit within the flexible hose 22. By contraction of the flexible hose 22, the air therein will be compressed and thereby to raise the valve body 26. The air will flow out partly through the indentations 231 and partly through the air passage 253. When the pressure developed by the compressed air is exceeded by that exerted by the compression spring 27, the valve body 26 will be biased against the air passage 253.

On removal of the load upon the lavatory seat 11, the coil spring 14 will exert a force to raise the lavatory seat 11. However, before moving the lavatory seat 11 to a raised position, the coil spring 14 has to pull the plunger 21 off the flexible hose 22 at first. In the first stage, the flexible hose 22 contains air at a pressure far lower than the external atmospheric pressure. The difference between the air pressure within the flexible hose 22 and the atmospheric pressure must be balanced before the plunger 21 will separate from the flexible hose 22. As the coil spring 14 continues to bias the lavatory seat 11 to a raised position, the flexible hose 22 draws in the external air mostly through the indentations 231 and partly through the air passage 253. The strength of the compression spring 27 may partly determine the speed at which the air is either drawn in or expelled out. On the suction of the air, the flexible hose 22 will extend to tightly embrace the plunger 21. The slow suction of the external air into the flexible hose 22 will with the force exerted by the coil spring 14 finally force the lavatory seat 11 to a raised position. Thus, a certain time lag is produced. This avoids an abrupt return movement of the lavatory seat 11.

As many apparently widely different embodiments of this invention may be made without departing from the scope of this invention, it is to be understood that the invention is not limited to the specific embodiments thereof except as defined in the appended claims.

What I claim is:

1. A lavatory apparatus comprising: a bracket; a lavatory seat pivotally connected to said bracket for movement between a raised and a lowered position; biasing means mounted on the bracket for urging said lavatory seat to said raised position; a plunger connected to said bracket; a flexible hose connected to the underside of said lavatory seat and positioned to receive said plunger to form an essentially fluid tight seal therewith when said seat is in said lowered position; and damping means connected in fluid communication with said hose for slowly admitting air therein when a load is removed from said lavatory seat.

2. A lavatory apparatus as claimed in claim 1, wherein said damping means includes a check valve in fluid communication with said hose.

3. A lavatory apparatus as claimed in claim 1, wherein said flexible hose is connected to said lavatory seat by a circular connecting means, said connecting means having an upper surface lip and an inner lip, said inner lip defining a circumference smaller than the outside circumference of said flexible hose such that said flexible hose is held tightly within said connecting means and lies against said inner lip.

4. A lavatory apparatus as claimed in claim 3, wherein said circular connecting means defines at least one opening in its said upper surface lip.

5. A lavatory apparatus as claimed in claim 4, wherein said damping means lies within said connecting means and above said flexible hose.

6. A lavatory apparatus as claimed in claim 2, wherein said check valve is comprised of a circular valve seat having a base, a valve body; and a valve ring; said base defines an opening in its center and said circular valve seat comprises at least one flange about its inner circumference, said valve body being laterally movable within said valve seat and against said flange, said valve ring lying on said flange and partially encasing said valve body and thereby holding said valve body within said valve seat, said valve body acting to seal said opening defined in said valve seat base when said lavatory seat is in its said lowered position.

7. A lavatory seat as claimed in claim 6, wherein said damping means further includes a spring, said spring biasing said valve body against said valve seat base when said lavatory seat is in its said lowered position.

* * * * *